US012495850B2

(12) United States Patent
Xu et al.

(10) Patent No.: US 12,495,850 B2
(45) Date of Patent: Dec. 16, 2025

(54) COMBINED BUTT-LIFTING SHAPEWEAR

(71) Applicant: XIAMEN HEXIN INTERNATIONAL TRADE CO., LTD., Fujian (CN)

(72) Inventors: Zhennan Xu, Fujian (CN); Huijuan Lin, Fujian (CN)

( * ) Notice: Subject to any disclaimer, the term of this patent is extended or adjusted under 35 U.S.C. 154(b) by 115 days.

(21) Appl. No.: 18/488,940

(22) Filed: Oct. 17, 2023

(65) Prior Publication Data

US 2025/0024903 A1 Jan. 23, 2025

(30) Foreign Application Priority Data

Jul. 18, 2023 (CN) ..... 202321890060.6

(51) Int. Cl.
*A41D 27/00* (2006.01)
*A41D 1/06* (2006.01)

(52) U.S. Cl.
CPC ..... *A41D 27/00* (2013.01); *A41D 1/06* (2013.01); *A41B 2400/38* (2013.01)

(58) Field of Classification Search
CPC ..... A41D 27/00; A41D 1/06; A41B 2400/38
See application file for complete search history.

(56) References Cited

U.S. PATENT DOCUMENTS 3,023,419 A * 3/1962 Strahle ..... A41D 13/0017 2/406
D554,826 S * 11/2007 Hart ..... D2/704
11,857,011 B2 * 1/2024 Solano ..... A41D 7/00
2014/0323932 A1 * 10/2014 Holmes ..... A41F 1/00 601/84

* cited by examiner

*Primary Examiner* — Khoa D Huynh
*Assistant Examiner* — Erick I Lopez

(57) ABSTRACT

The utility model relates to a combined butt-lifting shapewear, including an outerwear and an innerwear. The outerwear has a body approaching side close to a body; the innerwear is located at the body approaching side of the outerwear; an upper end of the innerwear is combined at a corresponding part of the outerwear; and the innerwear is provided with a butt relaxation portion corresponding to butt and a butt-lifting shaping portion corresponding to a position below the butt. According to the utility model, the innerwear having the body shaping effect is additionally provided in an ordinary outerwear to achieve the body shaping and beautification effect and realize one-step dressing/undressing, thereby meeting the aesthetic requirements of users. The butt-lifting shaping portion is useful to achieve the butt lifting effect for users; and the butt relaxation portion is useful to improve the shaping effect and universality of products.

5 Claims, 11 Drawing Sheets

COMBINED BUTT-LIFTING SHAPEWEAR

BACKGROUND OF THE INVENTION

1. Technical Field

The utility model relates to the field of clothing technologies, and in particular to a combined butt-lifting shapewear.

2. Description of Related Art

The soft tissue structures of the abdomen and butt of a human body show strong plasticity. Hence, shaping pants, as a shaping underwear, can guide the flow of fat in the abdomen and butt by virtue of the high elasticity of fabrics and the assembly of different elastic fabrics, in order to constrict the surplus fat in the waist and abdomen and to lift the butt, thereby achieving the effect of modifying the curves of the lower part of the body. Most of the shaping pants have a butt cup design, by which the flab surrounding the butt are extruded to achieve the effect of constricting and lifting the butt. However, current shaping pants are designed with compressive butt cups, which induce greater pressure on the butt, in particular for women with plump butt, and easily lead to discomfort. Moreover, the butt cups show poor applicability to the hip circumferences of women, who can hardly choose suitable shaping pants to use.

BRIEF SUMMARY OF THE INVENTION

An object of the utility model is to provide a combined butt-lifting shapewear, which can achieve the butt-lifting and shaping effect and meanwhile prevent the butt from being flattened due to the excessively tensioned body-shaping fabric to achieve the applicability to different hip circumferences, thereby improving the shaping effect and universality of products.

To achieve the object above, the utility model employs the following technical solution:

a combined butt-lifting shapewear includes an outerwear and an innerwear, wherein the outerwear has a body approaching side close to a body; the innerwear is located at the body approaching side of the outerwear; an upper end of the innerwear is combined at a corresponding part of the outerwear; and the innerwear is provided with a butt relaxation portion corresponding to butt and a butt-lifting shaping portion corresponding to a position below the butt.

Preferably, the upper end of the innerwear and the outerwear are combined together by stitching or bonding.

Preferably, the outerwear and the innerwear are further provided with side seams, respectively; and the side seams of the innerwear are partially or wholly stitched or attached to the side seams of the outwear.

Preferably, the outerwear has a structure of tops, bottoms, or bodysuit.

Preferably, the innerwear is further provided with a leg-constricting shaping portion corresponding to legs and/or an abdomen-constricting shaping portion corresponding to a front abdomen.

Preferably, the butt relaxation portion is of a hollow structure.

Preferably, the innerwear includes a pants portion corresponding to a region below a waist and an abdomen of a human body; the pants portion includes a front crotch piece, a back crotch piece, and a butt-lifting belt; the front crotch piece and the back crotch piece form a style of T-back with the butt relaxation portion having a hollow structure formed corresponding to the butt; a middle portion of the butt-lifting belt is connected to the front and back crotch pieces at a crotch bottom, and left and right ends of the butt-lifting belt are connected to left and right ends of the front crotch piece; and the butt-lifting belt is wound outwards and upwards from a bottom end of a gluteal fold to form the butt-lifting shaping portion corresponding to a position below the butt.

Preferably, the innerwear includes a pants portion corresponding to a region below a waist and an abdomen of a human body; the pants portion is of a shorts structure with the butt relaxation portion having a hollow structure corresponding to the butt; and a portion below the butt relaxation portion is formed with the butt-lifting shaping portion made of a body-shaping clastic fabric.

Preferably, the butt relaxation portion is provided with a connecting belt at a position corresponding to a gluteal fold.

Preferably, the butt relaxation portion is a butt wrapping piece having a shirring structure in the middle.

Compared with the prior art, the utility model has the following beneficial effects.

The combined butt-lifting shapewear of the utility model includes the outerwear and the innerwear, which are combined together in such a way that the innerwear having the body shaping effect is additionally provided in an ordinary outerwear to achieve the body shaping and beautification effect and realize one-step dressing/undressing, thereby meeting the aesthetic requirements of users. The innerwear has the butt relaxation portion and the butt-lifting shaping portion; by the butt-lifting shaping portion, the flab, fat or the like at the butt of a human body is gathered and pulled up, thereby creating a round and cute butt shape to achieve the butt lifting effect for the users; and by the butt relaxation portion, the butt are prevented from being flattened due to the excessively tensioned body-shaping fabric to achieve the applicability to different hip circumferences, thereby improving the shaping effect and universality of products.

Figure 1:
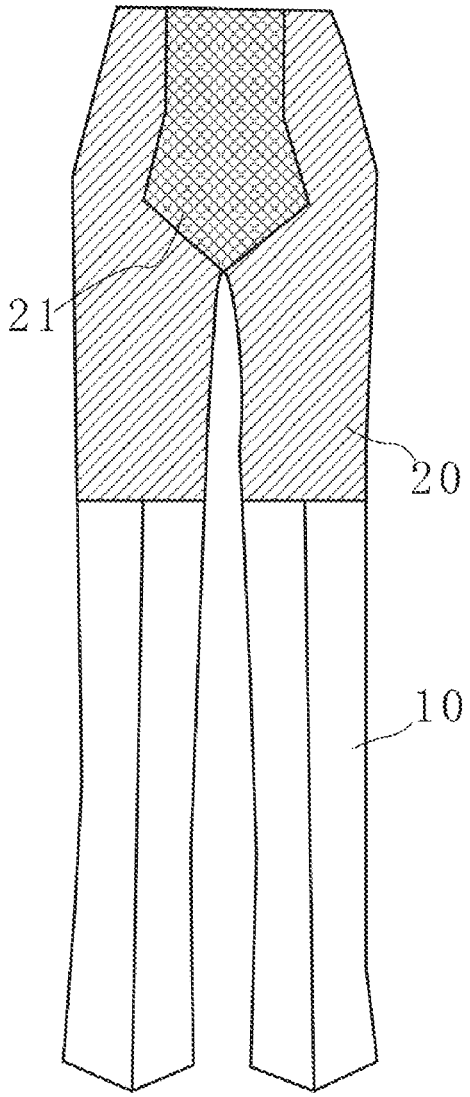
FIG. 1 is a front view of a combined butt-lifting shapewear in a reversely dressed state according to Embodiment 1 of the utility model.

Reference signs in the drawings are as follows: 10, outerwear; 20, innerwear; 21, abdomen-constricting shaping portion; 22, butt-lifting shaping portion; 23, butt relaxation portion; and 222, second double-breasted assembly.

DETAILED DESCRIPTION OF THE INVENTION

In order to make the above features and advantages of the utility model clearer and more understandable, embodiments are provided below in combination with drawings to make explanation in details.

Embodiment 1

Figure 2:
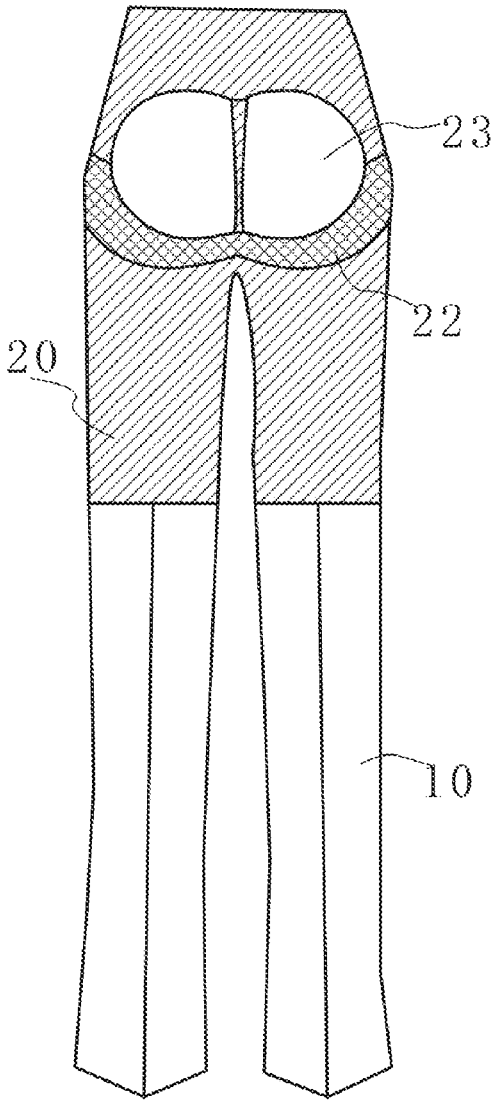
FIG. 2 is a back view of the combined butt-lifting shapewear in the reversely dressed state according to Embodiment 1 of the utility model.

As shown in FIG. 1 to FIG. 2, this embodiment provides a combined butt-lifting shapewear, which includes an outerwear 10 and an innerwear 20. The outerwear 10 has a body approaching side close to a body; and the innerwear 20 is located at the body approaching side of the outerwear 10, which completely covers the innerwear 20.

In this embodiment, the outerwear 10 is straight-leg long trousers, with the bottoms of trousers legs beside ankles and a waistband extending to cover the waist and abdomen region of a human body to form a type of high-waist trousers. A fabric for the outerwear 10 is a conventional material, which is not limited. In other examples, the outerwear 10 may also be bell-bottom trousers, horseshoe-bottom trousers, loose trousers, or Harem trousers.

In this embodiment, the innerwear 20 has a pants portion corresponding to a region below waist and abdomen of a human body, and a waist-abdomen portion extending upwards from an upper end of the pants portion and corresponding to the waist and abdomen region of the human body, thereby forming the high-waist trousers. In this embodiment, the upper end edge (waistband) of the innerwear 20 and corresponding part of the outerwear 10 are connected together by stitching. In this embodiment, the waist height of the outerwear 10 may be the same as that of the innerwear 20. For example, a low-waist, middle-waist, or high-waist form may be designed. In this embodiment, the pants portion has a form of shorts having a hollow structure corresponding to the butt, with the waist-abdomen portion in a middle-waist form.

In this embodiment, the innerwear 20 is wholly made of a body-shaping elastic fabric. Specifically, the part of the waist-abdomen portion corresponding to a front abdomen region is provided as an abdomen-constricting shaping portion 21 of a double-layer elastic fabric structure, and the abdomen-constricting shaping portion 21 extends downwards to a crotch. The part of the pants portion corresponding to the butt has a hollow structure to form a butt relaxation portion 23, with an upper edge shaped as a reversed W-curve and a lower edge shaped as a W-curve; and the hollow structure prevents the butt from being flattened due to the excessively tensioned body-shaping fabric, and thus can adapt to different hip circumferences, thereby improving the shaping effect and universality of products. The part of the butt relaxation portion 23 corresponding to the gluteal fold is provided with a connecting belt to shape the butt relaxation portion 23 into a co shape. In addition, the part of the pants portion corresponding to the position below the butt is provided as a W-shaped butt-lifting shaping portion 22 of the double-layer elastic fabric structure, in order to gather and pull up the flab, fat or the like at the lateral and lower parts of the butt of the human body to the middle, thereby creating a round and cute butt shape to achieve the effect of constricting and lifting the butt for the users. The crotch bottom of the pants portion is made of an antimicrobial skin-fit material, and other portions of the innerwear 20 have a single-layer elastic fabric structure, for example, a breathable nylon-spandex mesh fabric.

Embodiment 2

Figure 3:
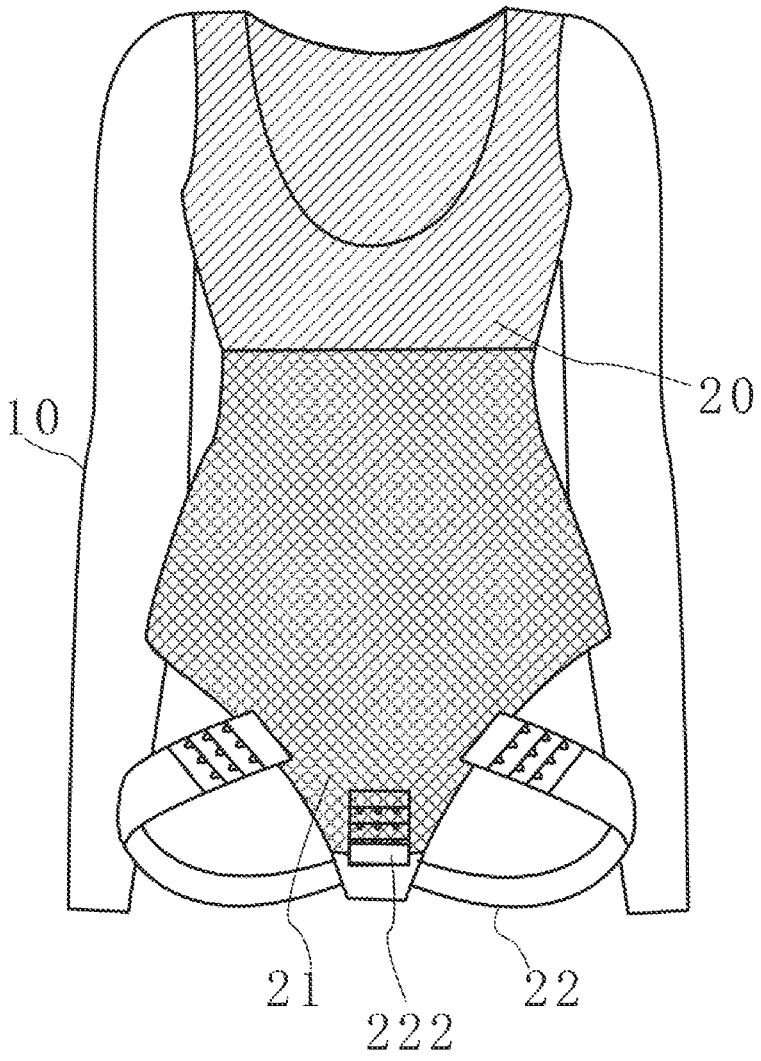
FIG. 3 is a front view of a combined butt-lifting shapewear in a reversely dressed state according to Embodiment 2 of the utility model.
Figure 4:
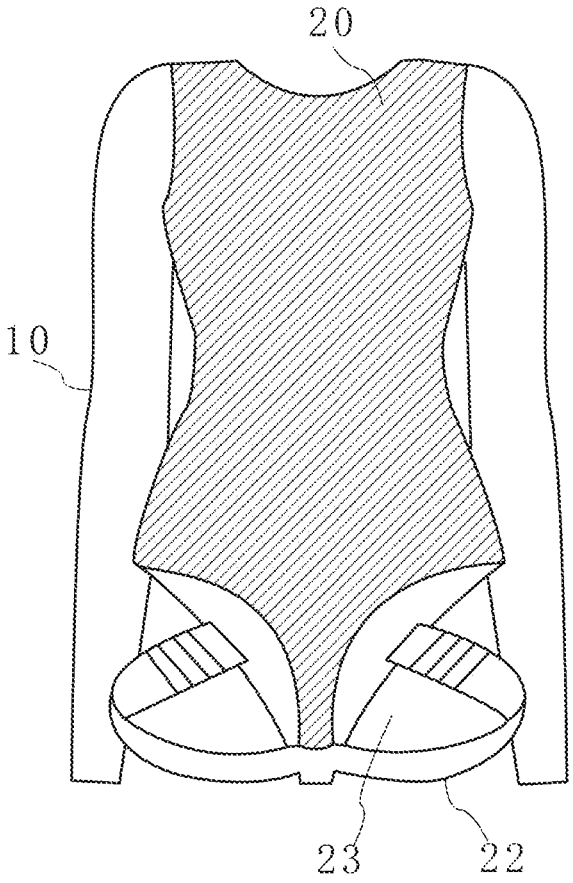
FIG. 4 is a back view of the combined butt-lifting shapewear in the reversely dressed state according to Embodiment 2 of the utility model.
Figure 5:
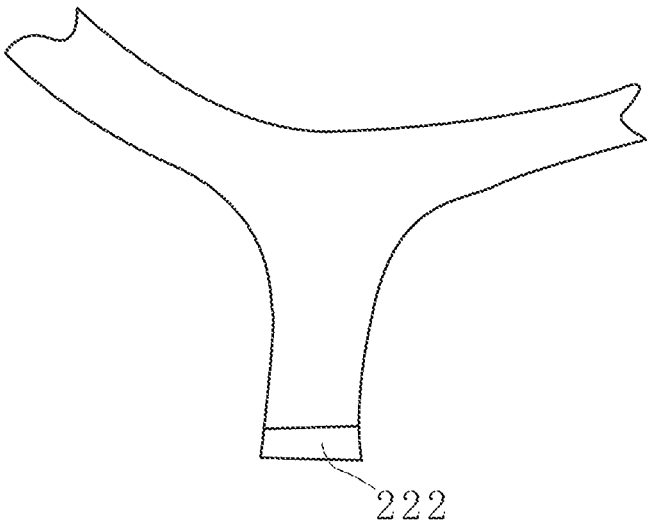
FIG. 5 is a schematic structural diagram of a butt-lifting belt according to Embodiments 2 and 6 of the utility model.

As shown in FIG. 3 to FIG. 5, this embodiment provides a combined butt-lifting shapewear, which includes an outerwear 10 and an innerwear 20. The outerwear 10 has a body approaching side close to a body; and the innerwear 20 is located at the body approaching side of the outerwear 10, which covers an upper body portion of the innerwear 20.

In this embodiment, the outerwear 10 is a sleeved T-shirt having outerwear armholes and an outerwear neckline. The fabric of the outwear 10 is a conventional material, which is not limited. The innerwear 20 is of a jumpsuit structure, and has a pants portion corresponding to a region below the waist and abdomen of a human body, and the upper body portion extending upwards from an upper end of the pants portion and corresponding to the upper body of a human; and the upper body portion is provided with innerwear armholes and an innerwear neckline. In this embodiment, the upper end edges (the innerwear armholes and innerwear neckline) of the innerwear 20 and the corresponding parts of the outerwear 10 are connected together by stitching (or may be attached in other examples).

In this embodiment, the part of the innerwear 20 corresponding to a front abdomen region is provided as an abdomen-constricting shaping portion 21 of a double-layer elastic fabric structure, and the abdomen-constricting shaping portion 21 extends downwards to a crotch bottom. The pants portion includes a front crotch piece, a back crotch piece, and a butt-lifting belt corresponding a position below the butt; the front crotch piece and the back crotch piece form a style of T-back and has a butt relaxation portion 23 with a hollow structure corresponding to the butt; and the hollow structure prevents the butt from being flattened due to the excessively tensioned shaping fabric, and thus can adapt to different hip circumferences, thereby improving the shaping effect and universality of products. The butt-lifting belt is connected to the left and right ends of an upper portion of the front crotch piece of the pants portion by means of a first double-breasted assembly; the bottom end of the butt-lifting belt is connected to the bottom end of the front crotch piece by means of a second double-breasted assembly 222, and is connected by stitching to the bottom end of the back crotch piece; the butt-lifting belt has a butt-lifting shaping portion 22 formed to a position below the butt, and the butt-lifting belt is wound outwards and upwards from the bottom end of the gluteal fold to wind the roots of both thighs of a human body, in order to gather and pull up the flab, fat or the like at the lower part of the butt of a human body, thereby creating a round and cute butt shape to achieve the butt-lifting effect for a user.

The second double-breasted assembly 222 includes a hook set fixedly disposed on the butt-lifting belt and a loop set fixedly disposed on the bottom end of the front crotch piece. The loop set is provided with a plurality of loop rows arranged vertically, and is coordinately hooked with the hook set to allow one of the loop rows to fixedly combine the butt-lifting belt and the front crotch piece together, such that the crotch of a human body can be kept covered and when the hooking relationship is released, can be exposed to facilitate a user in defecation, without removing other portions, and at the same time, the dressing and undressing of the user are facilitated. In addition, the hooking position of the hook set can be adjusted for proper tightness, in order to adapt to different users.

Embodiment 3

Figure 6:
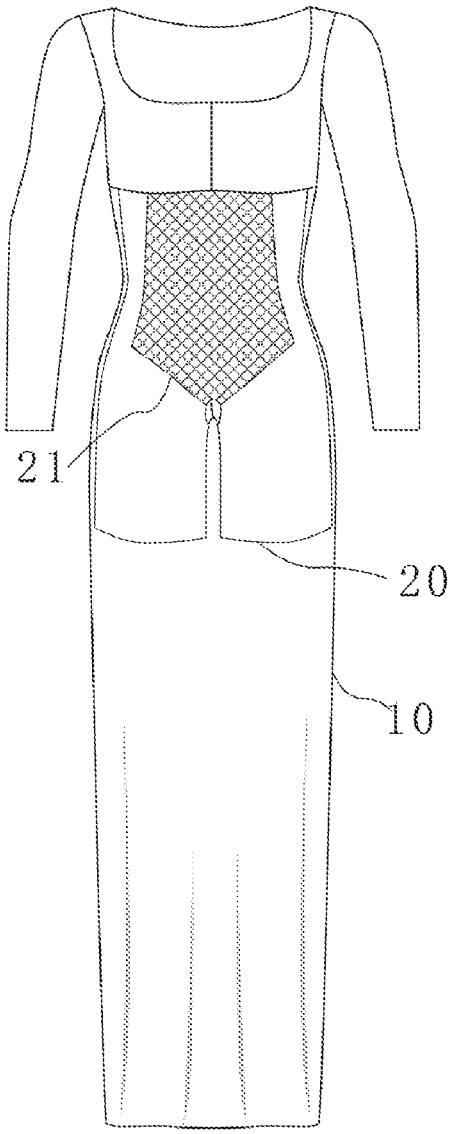
FIG. 6 is a front perspective view of a combined butt-lifting shapewear according to Embodiment 3 of the utility model.
Figure 7:
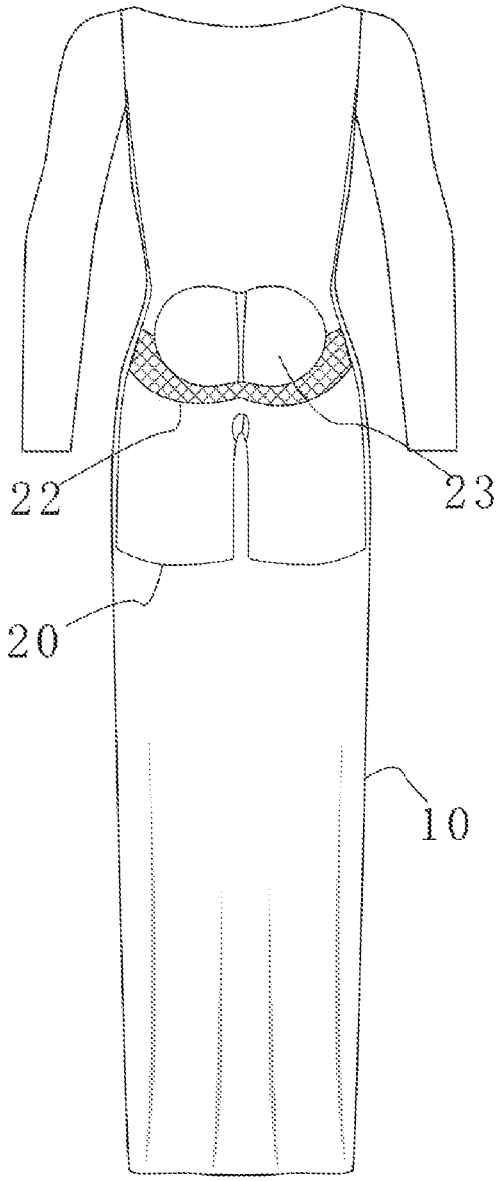
FIG. 7 is a back perspective view of the combined butt-lifting shapewear according to Embodiment 3 of the utility model.

As shown in FIG. 6 to FIG. 7, this embodiment provides a combined butt-lifting shapewear, which includes an outerwear 10 and an innerwear 20. The outerwear 10 has a body approaching side close to a body; and the innerwear 20 is located at the body approaching side of the outerwear 10, which completely covers the innerwear 20.

In this embodiment, the outerwear 10 is a dress; the innerwear 20 has a pants portion corresponding to a region below the waist and abdomen of a human body, and a waist-abdomen portion extending upwards from an upper end of the pants portion and corresponding to the waist and abdomen region of the human body, thereby forming high-waist trousers. In this embodiment, the form of the pants portion is of a shorts structure having a hollow structure corresponding to the butt, and the waist-abdomen portion is in a middle-waist form. In this embodiment, the upper end edge (waist band) of the innerwear 20 and the corresponding part of the outerwear 10 are connected together by stitching.

In this embodiment, the innerwear 20 is wholly made of a body-shaping elastic fabric. Specifically, the part of the waist-abdomen portion corresponding to a front abdomen region is provided as an abdomen-constricting shaping portion 21 of a double-layer elastic fabric structure, and the abdomen-constricting shaping portion 21 extends downwards to the crotch. The part of the pants portion corresponding to the butt has a hollow structure to form a butt relaxation portion 23, with an upper edge shaped as a reversed W-curve and a lower edge shaped as a W-curve; the hollow structure prevents the butt from being flattened by the excessively tensioned body-shaping fabric, and thus can adapt to different hip circumferences, thereby improving the shaping effect and universality of products. The part of the butt relaxation portion 23 corresponding to the gluteal fold is provided with a connecting belt to shape the butt relaxation portion 23 into a ∞ shape. In addition, the part of the pants portion corresponding to the position below the butt is provided as a W-shaped butt-lifting shaping portion 22 of the double-layer elastic fabric structure, in order to gather and pull up the flab, fat or the like at the lateral and lower parts of the butt of a human body to the middle, thereby creating a round and cute butt shape to achieve the effect of constricting and lifting the butt for users. The crotch bottom of the pants portion is made of a detachable antimicrobial skin-fit crotch fabric, or is a piece-overlapping openable crotch, or a zipped crotch; and other portions of the innerwear 20 have a single-layer elastic fabric structure, for example, a breathable nylon-spandex mesh fabric.

Embodiment 4

Figure 8:
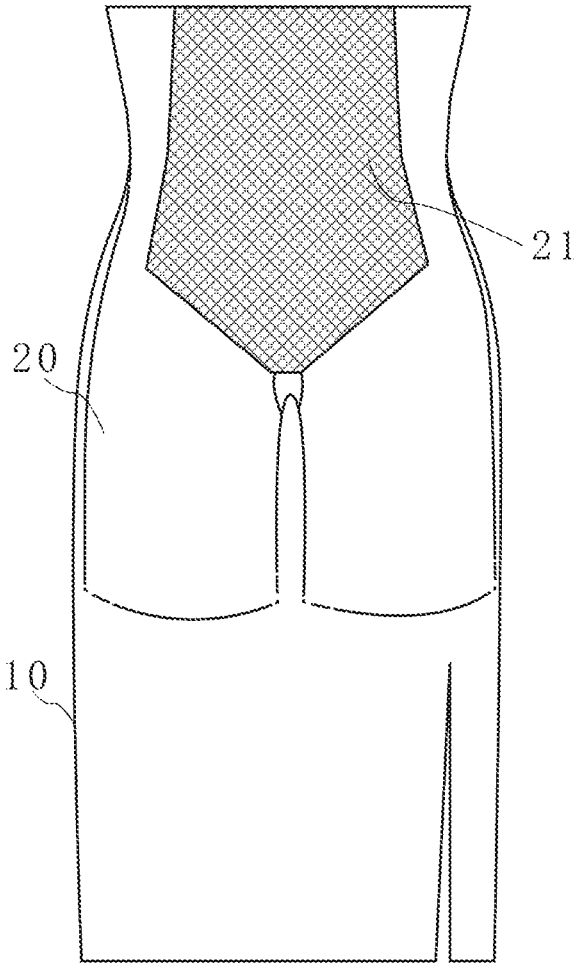
FIG. 8 is a front perspective view of a combined butt-lifting shapewear according to Embodiment 4 of the utility model.
Figure 9:
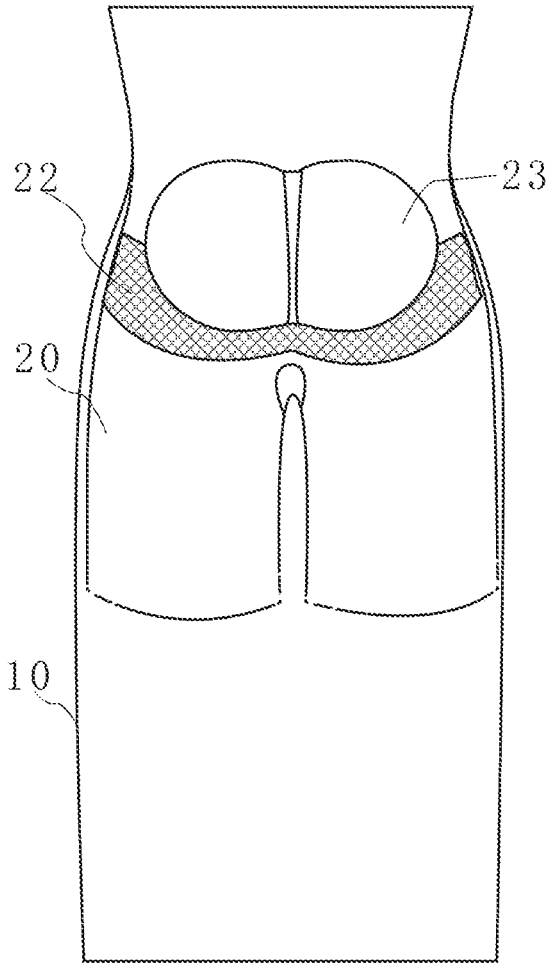
FIG. 9 is a back perspective view of the combined butt-lifting shapewear according to Embodiment 4 of the utility model.

As shown in FIG. 8 to FIG. 9, this embodiment provides a combined butt-lifting shapewear, which includes an outerwear 10 and an innerwear 20. The outerwear 10 has a body approaching side close to a body; the innerwear 20 is located at the body approaching side of the outerwear 10, which completely covers the innerwear 20.

In this embodiment, the outerwear 10 is a waist skirt; the innerwear 20 has a pants portion corresponding to a region below the waist and abdomen of a human body, and a waist-abdomen portion extending upwards from an upper end of the pants portion and corresponding to the waist and abdomen region of the human body, thereby forming high-waist trousers. In this embodiment, the form of the pants portion is of a shorts structure having a hollow structure corresponding to the butt, and the waist-abdomen portion is in a middle-waist form. In this embodiment, the upper end edge (waist band) of the innerwear 20 and the corresponding part of the outerwear 10 are connected together by stitching.

In this embodiment, the innerwear 20 is wholly made of a body-shaping elastic fabric. Specifically, the part of the waist-abdomen portion corresponding to a front abdomen region is provided as an abdomen-constricting shaping portion 21 of a double-layer elastic fabric structure, and the abdomen-constricting shaping portion 21 extends downwards to the crotch. The part of the pants portion corresponding to the butt has a hollow structure to form a butt relaxation portion 23, which is provided with a connecting belt corresponding to the gluteal fold to shape the butt relaxation portion 23 into a co shape, with an upper edge shaped as a reversed W-curve and a lower edge shaped as a W-curve; and the hollow structure prevents the butt from being flattened by the excessively tensioned body-shaping fabric, and thus can adapt to different hip circumferences, thereby improving the shaping effect and universality of products. In addition, the part of the pants portion corresponding to the position below the butt is provided as a W-shaped butt-lifting shaping portion 22 of the double-layer elastic fabric structure, in order to gather and pull up the flab, fat or the like at the lateral and lower parts of the butt of a human body to the middle, thereby creating a round and cute butt shape to achieve the effect of constricting and lifting the butt for users. The crotch bottom of the pants portion is made of a detachable antimicrobial skin-fit material, or is a piece-overlapping openable crotch, or a zipped crotch; and other portions of the innerwear 20 have a single-layer elastic fabric structure, for example, a breathable nylon-spandex mesh fabric.

Embodiment 5

Figure 10:
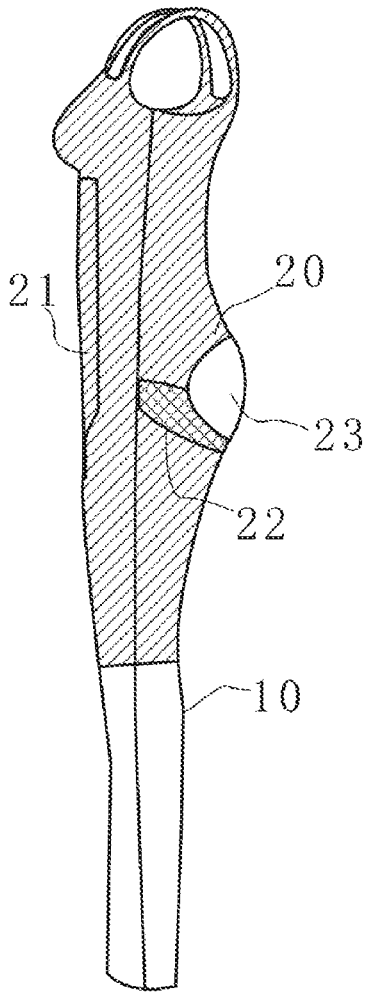
FIG. 10 is a side view of a combined butt-lifting shapewear in a reversely dressed state according to Embodiment 5 of the utility model.

As shown in FIG. 10, this embodiment provides a combined butt-lifting shapewear, which includes an outerwear 10 and an innerwear 20. The outerwear 10 has a body approaching side close to a body; the innerwear 20 is located at the body approaching side of the outerwear 10, which completely covers the innerwear 20.

In this embodiment, the outerwear 10 and the innerwear 20 are both jumpsuits, and is each provided with a pants portion corresponding to a region below the waist and abdomen of a human body, and an upper body portion extending upwards from an upper end of the pants portion and corresponding to the upper body of a human; and the upper body portion is provided with armholes and a neckline. In this embodiment, the upper end edges (the armholes and neckline) of the innerwear 20 and the corresponding parts of the outerwear 10 are connected together by stitching (or may be attached in other examples). The pants portion of outerwear 10 is long trousers, and the pants portion of the innerwear is shorts.

In this embodiment, the innerwear 20 is wholly made of a body-shaping elastic fabric. Specifically, the part of the waist-abdomen portion corresponding to a front abdomen region is provided as an abdomen-constricting shaping portion 21 of a double-layer elastic fabric structure, and the abdomen-constricting shaping portion 21 extends downwards to the crotch. The part of the pants portion corresponding to the butt has a hollow structure to form a butt relaxation portion 23, with an upper edge shaped as a reversed W-curve and a lower edge shaped as a W-curve; the hollow structure prevents the butt from being flattened due to the excessively tensioned body-shaping fabric, and thus can adapt to different hip circumferences, thereby improving the shaping effect and universality of products. The part of the butt relaxation portion 23 corresponding to the gluteal fold is provided with a connecting belt to shape the butt relaxation portion 23 into a ∞ shape. In addition, the part of the pants portion corresponding to the position below the butt is provided as a W-shaped butt-lifting shaping portion 22 of the double-layer elastic fabric structure, in order to gather and pull up the flab, fat or the like at the lateral and lower parts of the butt of a human body to the middle, thereby creating a round and cute butt shape to achieve the effect of constricting and lifting the butt for users. The crotch bottom of the pants portion is made of an antimicrobial skin-fit material, and other portions of the innerwear 20 have a single-layer clastic fabric structure, for example, a breathable nylon-spandex mesh fabric.

Embodiment 6

Figure 11:
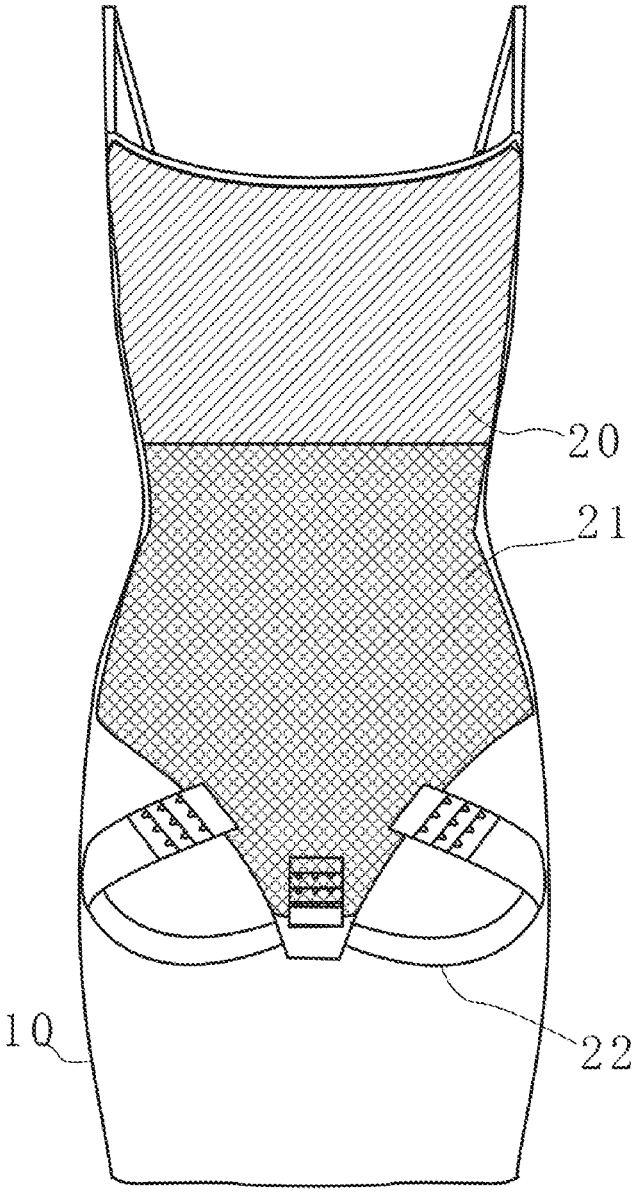
FIG. 11 is a front perspective view of a combined butt-lifting shapewear according to Embodiment 6 of the utility model.

As shown in FIG. 11, this embodiment provides a combined butt-lifting shapewear, including an outerwear 10 and an innerwear 20. This embodiment differs from Embodiment 3 above in that the outerwear 10 is a dress.

Embodiment 7

Figure 12:
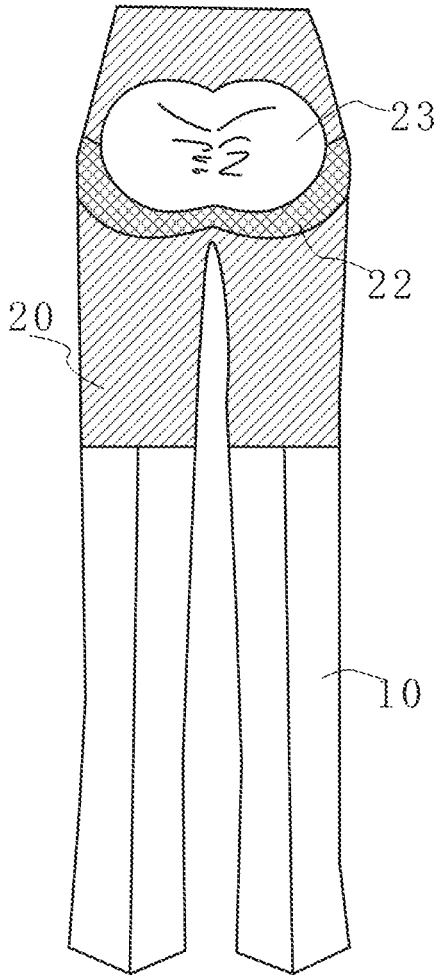
FIG. 12 is a back view of a combined butt-lifting shapewear in a reversely dressed state according to Embodiment 7 of the utility model.

As shown in FIG. 12, this embodiment provides a combined butt-lifting shapewear, including an outerwear 10 and an innerwear 20. This embodiment differs from Embodiment 1 above in that the innerwear 20 has a different pants portion. Specifically, the part of the pants portion of the innerwear 20 corresponding to the butt has a butt-wrapping piece with a shirring structure in the middle, instead of the hollow structure in Embodiment 1. The shirring structure is useful in increasing the capacity of butt cups, reducing the extrusion to the butt, and preventing the butt from being flattened due to the excessively tensioned body-shaping fabric, and can adapt to different hip circumferences, thereby improving the shaping effect and universality of products.

The above illustration and description provide the basic principles and main features as well as the advantages of the present invention. Those skilled in the industry should understand that the utility model is not limited by the embodiments described above. The embodiments described above and the description in the specification are merely for a purpose of explaining the principle of the utility model. There may be a variety of variations and improvements made to the utility model without departing from the inventive spirit and scope of the utility model. These variations and improvements shall fall within the scope claimed by the utility model. The scope claimed by the utility model is subject to the appended claims and equivalents thereof.

What is claimed is:

1. A combined butt-lifting shapewear, comprising an outerwear and an innerwear, wherein the outerwear has a body approaching side configured to be close to a body; the innerwear is located at the body approaching side of the outerwear; an upper end of the innerwear is combined at a corresponding part of the outerwear; and the innerwear is provided with a butt relaxation portion corresponding to butt and a butt-lifting shaping portion corresponding to a position below the butt;

wherein the innerwear comprises a pants portion corresponding to a region below a waist and an abdomen of a human body; the pants portion comprises a front crotch piece, a back crotch piece, and a butt-lifting belt; the front crotch piece and the back crotch piece form a style of T-back, with the butt relaxation portion having the hollow structure formed corresponding to the butt; a middle portion of the butt-lifting belt is connected to the front and back crotch pieces at a crotch bottom, and left and right ends of the butt-lifting belt are connected to left and right ends of the front crotch piece; and the butt-lifting belt is configured to be wound outwards and upwards from a bottom end of a gluteal fold to form the butt-lifting shaping portion corresponding to a position below the butt;

wherein the butt-lifting belt is connected to left and right ends of an upper portion of the front crotch piece of the pants portion by means of a first double-breasted assembly; and a bottom end of the butt-lifting belt is connected to the bottom end of the front crotch piece by means of a second double-breasted assembly.

2. The combined butt-lifting shapewear according to claim 1, wherein the upper end of the innerwear and the outerwear are combined together by stitching or bonding.

3. The combined butt-lifting shapewear according to claim 1, wherein the butt relaxation portion is of a hollow structure.

4. The combined butt-lifting shapewear according to claim 1, wherein a part of the innerwear corresponding to a front abdomen region is provided as an abdomen-constricting shaping portion of a double-layer elastic fabric structure, and the abdomen-constricting shaping portion extends downwards to the crotch bottom.

5. The combined butt-lifting shapewear according to claim 1, wherein the second double-breasted assembly includes a hook set fixedly disposed on the butt-lifting belt and a loop set fixedly disposed on the bottom end of the front crotch piece; the loop set is provided with a plurality of loop rows arranged vertically, and is coordinately hooked with the hook set to allow one of the loop rows to fixedly combine the butt-lifting belt and the front crotch piece together.

* * * * *